US010065285B2

(12) United States Patent
Matsui et al.

(10) Patent No.: US 10,065,285 B2
(45) Date of Patent: Sep. 4, 2018

(54) METHOD OF PREPARING SUBSTRATE

(71) Applicant: SHIN-ETSU CHEMICAL CO., LTD., Tokyo (JP)

(72) Inventors: Harunobu Matsui, Joetsu (JP); Daijitsu Harada, Joetsu (JP); Atsushi Watabe, Joetsu (JP); Shuhei Ueda, Joetsu (JP); Masaki Takeuchi, Joetsu (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 0 days.

(21) Appl. No.: 13/675,302

(22) Filed: Nov. 13, 2012

(65) Prior Publication Data

US 2013/0122785 A1 May 16, 2013

(30) Foreign Application Priority Data

Nov. 15, 2011 (JP) ..... 2011-249345

(51) Int. Cl.
*B24B 37/04* (2012.01)
*B24D 3/28* (2006.01)
*B24B 37/24* (2012.01)

(52) U.S. Cl.
CPC ..... *B24B 37/042* (2013.01); *B24B 37/044* (2013.01); *B24B 37/24* (2013.01); *B24D 3/28* (2013.01)

(58) Field of Classification Search
CPC ..... B24B 37/042; B24B 37/044; B24B 37/24; B24D 3/28
USPC ..... 451/36; 51/298
See application file for complete search history.

(56) References Cited

U.S. PATENT DOCUMENTS

| | | | | |
|---|---|---|---|---|
| 5,958,794 | A * | 9/1999 | Bruxvoort | B24B 7/228 216/88 |
| 6,095,902 | A | 8/2000 | Reinhardt | |
| 6,117,000 | A | 9/2000 | Anjur et al. | |
| 6,458,018 | B1 * | 10/2002 | Goers et al. | 451/41 |
| 6,736,709 | B1 * | 5/2004 | James | B24B 37/26 451/287 |
| 7,923,178 | B2 * | 4/2011 | Ito et al. | 430/5 |
| 2004/0259480 | A1 | 12/2004 | Hung et al. | |
| 2006/0125133 | A1 | 6/2006 | Huh et al. | |
| 2007/0218279 | A1 | 9/2007 | Nonaka et al. | |
| 2007/0232200 | A1 * | 10/2007 | Natsui | B24B 7/228 451/41 |
| 2010/0086864 | A1 | 4/2010 | Kojima et al. | |
| 2010/0136372 | A1 * | 6/2010 | Ishida et al. | 428/846.9 |

FOREIGN PATENT DOCUMENTS

| | | | |
|---|---|---|---|
| CN | 1316939 | A | 10/2001 |
| CN | 1946516 | A | 4/2007 |
| JP | 2004-255467 | A | 9/2004 |
| JP | 2006-255828 | A | 9/2006 |
| JP | 2007-054944 | A | 3/2007 |
| JP | 2007-213020 | A | 8/2007 |
| JP | 2007-307641 | A | 11/2007 |
| JP | 2008-307631 | A | 12/2008 |
| JP | 2011-194508 | A | 10/2011 |
| JP | 2011-212809 | A | 10/2011 |
| WO | 2007/072890 | A1 | 6/2007 |

OTHER PUBLICATIONS

Japanese Office Action dated Aug. 26, 2014, issued in Japanese Patent Application No. 2011-249345 (3 pages).
Office Action dated Dec. 24, 2015, issued in counterpart Chinese Patent Application No. 201210599155.2, with English translation. (13 pages).
Office Action dated Jan. 29, 2016, issued in Malaysian Patent Application No. PI 2012004870. (3 pages).
Office Action dated Nov. 3, 2016, issued in counterpart Chinese Application No. 201210599155.2, with English translation. (13 pages).
European Search Report dated Jun. 13, 2016, issued in counterpart European Patent Application No. 12191945.0. (6 pages).

* cited by examiner

*Primary Examiner* — Christopher M Koehler
*Assistant Examiner* — Joel Crandall
(74) *Attorney, Agent, or Firm* — Westerman, Hattori, Daniels & Aridan, LLP

(57) ABSTRACT

A substrate is prepared by polishing a surface of the substrate using a polishing pad while feeding a slurry. The polishing pad has a porous nap layer which comes in contact with the substrate surface and is made of a base resin comprising at least three resins, typically an ether resin, ester resin, and polycarbonate resin. The polished substrate has a highly flat surface with a minimal number of defects.

5 Claims, No Drawings

METHOD OF PREPARING SUBSTRATE

CROSS-REFERENCE TO RELATED APPLICATION

This non-provisional application claims priority under 35 U.S.C. § 119(a) on Patent Application No. 2011-249345 filed in Japan on Nov. 15, 2011, the entire contents of which are hereby incorporated by reference.

TECHNICAL FIELD

This invention relates to a method of preparing substrates having a flat, smooth, substantially defect-free surface, typically synthetic quartz glass or silicon substrates for use in the advanced technology as photomasks, nanoimprint molds and liquid crystal color filters.

BACKGROUND ART

In manufacturing a component to be incorporated into a precision equipment, such as semiconductor integrated circuit, the advanced technology such as photolithography or nanoimprint lithography is often employed. On use of such technology, it is important that substrates have as few defects as possible on their surface. For instance, if a photomask used in the photolithography as an original for exposure bears defects, there is a risk of forming a defective pattern because the defects are directly transferred to the pattern. To accommodate a need for ultra-miniaturization of patterns as found in the latest EUV lithography, the substrate serving as the original is also required to have a flat, smooth, substantially defect-free surface.

Synthetic quartz glass substrates for use as photomasks and liquid crystal filters must have high flatness, high smoothness, and low defectiveness. They are subjected to several resurfacing steps including lapping and polishing steps before they are ready for use in the subsequent process. The lapping step is to remove work strains introduced by slicing from an ingot. The polishing step is to mirror finish the substrate for modifying the flatness and shape of its surface. The final polishing step is to polish the substrate with colloidal silica abrasive having a small particle size, obtaining a substrate with a flat and smooth surface and devoid of microscopic defects.

For example, Patent Document 1 describes a method of acquiring a least defective substrate wherein the final polishing step includes a polishing step using a polishing pad having a nap layer made of ester resin and colloidal silica having a small particle size. Patent Document 2 discloses a method of lapping a large-size substrate using a lapping plate which is provided with grooves for allowing a flow rate of slurry. Further, Patent Document 3 describes a method of polishing a substrate so as to reduce defects wherein the final polishing step uses an expanded urethane suede polishing pad having a nap layer provided with grooves of predetermined depth.

The synthetic quartz glass substrates which can comply with not only the ArF excimer laser lithography, but also the EUV lithography are required to have a minimal number of defects on their surface. In the event of large-size substrates which are normally difficult to provide a slurry supply, it is required that the slurry be sufficiently distributed over the substrate so as to minimize the number of defects on substrate surface.

Although the method of Patent Document 1 is satisfactory as a general process when photomask substrates having a line width of down to 45 nm are manufactured, it is difficult to manufacture ultra-low defective substrates free of defects having a major diameter of the order of 40 nm. Even if such ultra-low defective substrates can be manufactured, the manufacture yield is very low. As long as the polishing pad and slurry are fresh, they may have full abilities to perform in the final polishing step. Once either one begins degradation, the balance of polishing conditions is quickly broken. Particularly in the event of large-size substrates, the slurry thickens and gels so that the slurry may not be distributed throughout the substrate, causing more defects to the substrate surface and negating the long-term service.

Although the method of Patent Document 2 is effective in distributing the slurry throughout the substrate, there is a concern that the flatness of lapped substrates be exacerbated by a certain factor like a phenomenon that the lapping plate will be deformed with the lapse of time, since the lapping plate itself is provided with grooves. It is expectable that substrates with a minimal number of defects can be manufactured by the method of Patent Document 3 as long as the lapping pad is fresh. For the reasons including wear of the nap layer, deformation of groove shape, and reduction of groove depth which will occur during successive operation of the polishing pad, it is deemed difficult to acquire least defective substrates in a consistent manner.

CITATION LIST

Patent Document 1: JP-A 2007-213020 (WO 2007072890)
Patent Document 2: JP-A 2007-054944
Patent Document 3: JP-A 2004-255467

SUMMARY OF INVENTION

An object of the invention is to provide a method of preparing a flat, smooth, substantially defect-free substrate, typically a synthetic quartz glass or silicon substrate for use as ICs, photomasks, and liquid crystal display large-size substrates wherein the final polishing step is modified so as to minimize the number of defects and confer a high flatness to the substrate surface.

A substrate is prepared by polishing a substrate surface using a polishing pad and slurry. Focusing the base resin of which the nap layer of the polishing pad is made, the inventors have found that better results are obtained from the use of a polishing pad having a nap layer made of a base resin comprising at least three resins including an ether resin, and preferably comprising an essential ether resin and further at least two resins including an ester resin and a polycarbonate resin. Using the polishing pad of this design, all substrates of different sizes can be polished so that they may have a minimal number of defects and high flatness on their surface.

In one aspect, the invention provides a method of preparing a substrate, comprising the step of polishing a surface of the substrate using a polishing pad along with a polishing slurry, the polishing pad having a porous nap layer made of a base resin comprising at least three resins including an ether resin, the nap layer coming in contact with the substrate surface.

In a preferred embodiment, the base resin of which the nap layer is made comprises the ether resin, and further at least two resins including an ester resin and a polycarbonate resin.

In a preferred embodiment, the polishing slurry contains colloidal particles, which are more preferably colloidal particles of silica, ceria or zirconia.

In a preferred embodiment, the polishing step is a final polishing step.

In a preferred embodiment, the substrate is a synthetic quartz glass or silicon substrate.

Advantageous Effects of Invention

According to the invention, substrates having a minimal number of defects and a high flatness on their surface can be prepared. Other advantages include extended service life of the polishing pad, cost reduction and improved productivity.

DESCRIPTION OF PREFERRED EMBODIMENTS

A polishing pad is constructed by impregnating a support of nonwoven fabric with a resin for thereby filling the nonwoven fabric support with the resin and simultaneously forming a resin layer on the support surface. The resin layer is referred to as "nap layer." In one embodiment of the invention, the polishing pad includes a nap layer which is made of a base resin composition comprising at least three resins including an ether resin, preferably at least three resins including an ether resin, ester resin, and polycarbonate resin, and the nap layer has a plurality of pores.

It is first described why the ether resin is essential in the base resin composition of the nap layer. When a substrate is polished by a polishing pad, polishing heat is released due to friction between the pad and the substrate. As water in the slurry evaporates by the polishing heat, abrasive grains in the slurry tend to agglomerate into large particles, which are likely to flaw the substrate surface. As a result of evaporation of water in the slurry, the slurry also loses fluidity, which increases the frictional resistance between the pad and the substrate, causing the nap layer to be worn.

It is believed that if an ether resin is used in the nap layer, the polishing pad is improved in slurry retention in the nap layer proper, exactly pores in the nap layer because of easy access between oxygen in the ether resin and water molecules in the slurry. This allows an abundant supply of the slurry between the polishing pad and the substrate, preventing abrasive grains from agglomerating and the nap layer from being worn owing to the polishing heat.

To the polishing slurry which is concomitantly fed in the polishing step, for example, colloidal particle-laden polishing slurry, an additive is often added for improving the dispersion of abrasive grains. A certain additive may cause a large shift of the polishing slurry to an alkaline or acidic side, which may induce alkali or acid-aided hydrolysis, leading to a failure of the nap layer.

In this situation as well, if an ether resin having chemical resistance is used in the nap layer, no hydrolysis takes place because of the absence of hydroxyl group in the ether portion although water molecules have an access thereto. As a result, even if the urethane portion of the polishing pad support is hydrolyzed, the ether resin-containing nap layer maintains chemical resistance and hydrolytic resistance, as compared with the nap layers containing ester resins and the like.

On the other hand, if the nap layer is made of a base resin composition consisting of an ether resin alone, the layer is weak against mechanical shear forces. Also, while the nap layer should ideally have pores penetrating straightforward to the surface, a large amount of surfactant must be added to the ether resin before such an ideal nap layer can be formed of the ether resin alone. If a large amount of surfactant is added, however, the surfactant tends to combine with abrasive grains, which are likely to adhere to the substrate surface, increasing protrusion defects. Furthermore, since numerous fine bubbles are generated in the nap layer forming step, the resin portion of the nap layer has a low density and is deformable. Also, since the ether resin has poor resistance to hot water, there arises a problem that if the temperature of the slurry is locally elevated by the polishing heat, linkages in the ether resin can be cleaved by water molecules at the locally elevated temperature, leading to a failure of the nap layer. Furthermore, the ether bond moiety has a possibility of acid cleavage by nucleophilic displacement reaction, there arises a problem that if acidic colloidal silica abrasive at about pH 1 is used, the ether resin may be degraded under polishing conditions at normal temperature, that is, the nap layer may fail.

For overcoming the above problems, it is effective to blend the ether resin with an ester resin. The addition of ester resin compensates for mechanical shear property, reduces the amount of surfactant added in the nap layer forming step as compared with the ether resin used alone, facilitates formation of perpendicularly extending pores, and increases the density of the resinous nap layer. Since the ester resin may be improved in chemical resistance by modifying the structure of monomers from which the ester resin is derived, the ester resin combined with the ether resin confers chemical resistance to the nap layer until a certain polishing life.

The ether/ester resin blend is insufficient with respect to wear resistance and mechanical shear under somewhat vigorous polishing conditions like increased loads and increased rotational speeds. To compensate for durability, further blending of a polycarbonate resin is recommended. The resulting nap layer has increased mechanical strength.

Namely, it has been found that by adding optionally modified alkali resistant resins to a resin having high slurry retention, the degradation of the nap layer by alkali or acid-aided hydrolysis induced by the polishing slurry concomitantly fed in the polishing step and the wear of the polishing pad can be simultaneously prevented.

By using a polishing pad having a nap layer made of a base resin composition comprising an essential ether resin and two or more other resins, substrates can be polished to a minimal number of defects and a high flatness on their surface. In addition, the nap layer is also improved in mechanical shear and alkali or acid resistance, the service life of the polishing pad is extended.

The base resin composition of which the nap layer is made comprises an essential ether resin and two or more other resins, typically an ester resin and a polycarbonate resin. Any other resins may be selected and added depending on the situation.

Suitable ether resins used herein include polyalkylene ethers such as polyhexamethylene ether, and polyphenylene ether. Suitable ester resins used herein include glycol type fatty acid polyesters such as polyethylene succinate, polybutylene succinate, and polyethylene adipate. Suitable polycarbonate resins used herein include polyalkylene carbonates such as polyethylene carbonate and polyhexamethylene carbonate. These resins are commercially available. Preferably the resins are mixed to form the nap layer-forming resin composition such that the resin composition may comprise 55 to 85% by weight of the ether resin, 10 to 35% by weight of the ester resin, and 5 to 10% by weight of the polycarbonate resin and optional other resins including polyurethane resin. Outside the range, the nap layer may be insufficient in the desired alkali or acid resistance or weak against mechanical shear forces.

Although the type of the nonwoven support of the polishing pad is not particularly limited, nonwoven supports composed of polyester and polyamide are preferred.

The polishing pad may be manufacture by any well-known methods. For example, an ether resin, ester resin, polycarbonate resin, and optional resin are dissolved in a compatible solvent such as N,N-dimethylformamide, dimethyl sulfoxide, tetrahydrofuran, or dimethylacetamide. A nonionic or anionic surfactant is added to the solution. A nonwoven support is treated with the solution so that the support is impregnated therewith and a resin layer is formed on the support surface. The resin layer is washed with water so that the surfactant therein is dissolved away. Finally the surface of the resin layer is polished and regulated, completing a nap layer. It is noted that the nap layer typically has a thickness of 400 to 550 μm although the thickness is not particularly limited. The support typically has a thickness of 1 to 2 mm.

While the nap layer contains pores, the pores preferably have a depth of 250 to 600 nm, more preferably 300 to 500 nm from the pad surface. Pores of less than 250 nm in depth may fail to hold a sufficient amount of the polishing slurry, adversely affecting the polishing rate. If pores are deeper than 600 nm, the nap layer is more likely to deform, resulting in polished substrates having low flatness.

The size (or diameter) of opening of pores is preferably in a range of 25 to 70 μm, more preferably 35 to 60 μm as major diameter. If the opening size is less than 25 μm, then abrasive grains may not enter pores, adversely affecting the polishing rate. If the opening size exceeds 70 μm, then abrasive grains may not be surely caught within pores.

The polishing pad used herein has the nap layer which may be grooved if desired. In the polishing of large-size substrates, it is difficult to spread the slurry throughout the substrate as compared with small-size substrates such as photomask-forming synthetic quartz substrates. In such cases, an ample supply of the slurry to the substrate is ensured using a grooved polishing pad. The shape of grooves may be, for example, V, U or the like. The pitch of grooves may be selected appropriate depending on the polishing conditions, and preferably falls in a range of 15 to 40 mm. Outside the range, a pad having grooves at a narrower pitch is likely to deform, often resulting in polished substrates having poor flatness or disordered shape; and the arrangement of grooves at a wider pitch may be less effective for providing an ample slurry supply.

The slurry which is concomitantly fed during the polishing step is based on abrasive grains in the form of colloidal particles. The abrasive grains preferably have a primary grain size of 5 to 2,000 nm, more preferably 10 to 1,500 nm, and even more preferably 20 to 1,200 nm. Outside the range, abrasive grains of smaller size are advantageous for rendering the substrate surface highly flat, but adversely affect cleaning after polishing because such smaller grains are likely to adhere to the substrate surface. Inversely, abrasive grains of larger size are effective for increasing the polishing rate and thus reducing the polishing time, from which an improvement in productivity is expectable, but worsen the surface roughness of polished substrates and are thus often inadequate for use in the final polishing step.

As the colloidal abrasive, commercially available products may be used as well as slurries of solid abrasive grains in deionized water. Examples of colloidal silica slurry include COMPOL®-50, COMPOL-80, COMPOL-120, and COMPOL-EXIII from Fujimi Inc., ST-XL, ST-YL, and ST-ZL from Nissan Chemical Industries Co., Ltd., Syton® from Dupont, and GP series from Fuso Chemical Co., Ltd. Examples of colloidal ceria slurry include NX series from Showa Denko K. K., and Mirek® series from Mitsui Mining & Smelting Co., Ltd. Examples of colloidal zirconia slurry include zirconium oxide series and stabilized zirconium oxide series from Daiichi Kigenso Kagaku Kogyo Co., Ltd., and Zyrox® series from Ferro Corp.

The process of polishing substrates using the above polishing pad along with the above polishing slurry is advantageous in that the life of the polishing pad is extended, the number of defects of a size detectable by a high-sensitivity defect detector is reduced, and the surface flatness of polished substrates is improved.

The substrate to be polished by the inventive method typically includes synthetic quartz glass substrates and silicon substrates which may be used in the semiconductor-related electronic materials, especially as photomasks, nanoimprint molds, LC color filters, and magnetic devices. Although the size of substrates is not particularly limited, suitable substrates to be polished include substrates of square shape, such as substrates of 5 inches squares and 6 inches squares, glass substrates of round shape such as wafers with a diameter of 6 inches and 8 inches, and large-size substrates such as G8 (1,220×1,400 mm) and G10 (1,620×1,780 mm) size.

The substrate may be suitably processed before it is subjected to the inventive method. For example, a synthetic quartz glass ingot is shaped, annealed, sliced, chamfered, lapped, and polished to a mirror finish before the substrate is subjected to the inventive method. In this sense, the inventive method is applied to the thus processed substrate as the final polishing step.

The polishing method of the invention is generally performed by a batchwise double-side polishing machine. For large-size substrates, a single-side polishing machine may be used. The polishing method may be performed in combination with another polishing technique such as single wafer polishing. Preferably the polishing pressure is in a range of 60 to 140 gf/cm$^2$ and the polishing allowance is in a range of 2 to 8 μm.

EXAMPLE

Examples are given below by way of illustration and not by way of limitation.

Example 1

A synthetic quartz glass substrate stock as sliced (6 inch squares and 6.35 mm thick) was lapped on a double-side lapping machine of planetary motion, and roughly polished on a double-side polishing machine of planetary motion, obtaining a starting substrate.

The starting substrate was polished using a polishing pad and slurry. The polishing pad had a nap layer made of a base resin composition consisting of three resins, 65 wt % of an ether resin, 30 wt % of an ester resin and 5 wt % of a polycarbonate resin and containing a plurality of pores having an average opening size of 50 μm. The polishing slurry was a water dispersion of colloidal silica having a $SiO_2$ concentration of 40 wt % (Fujimi Inc., particle size 76.8 nm). Polishing was performed under a pressure of 100 gf/cm$^2$ to an allowance (at least 2 μm) sufficient to remove damages caused by the rough polishing step. Polishing was followed by cleaning and drying.

The substrate was inspected for defects using a laser confocal optics high-sensitivity defect inspection system (Lasertec Corp.), finding an average of 1.1 defects with a major diameter of the order of 40 nm or greater. The substrate had a surface roughness (Rms) of 0.12 nm.

Example 2

A silicon wafer as sliced (diameter 8 inches, 1.0 mm thick) was worked as in Example 1, obtaining a starting substrate. Polishing was performed as in Example 1 except that the polishing pressure was 50 gf/cm$^2$. On similar analysis, the substrate had an average of 1.3 defects with a major diameter of the order of 40 nm or greater and a surface roughness (Rms) of 0.14 nm.

Comparative Example 1

The starting substrate was the same as in Example 1. Polishing was performed under the same conditions as in Example 1 except that the polishing pad had a nap layer made solely of an ester resin and containing a plurality of pores having an average opening size of 50 μm. On similar analysis, the substrate had an average of 5.7 defects with a major diameter of the order of 40 nm or greater and a surface roughness (Rms) of 0.20 nm.

Comparative Example 2

The starting substrate was the same as in Example 1. Polishing was performed under the same conditions as in Example 1 except that the polishing pad had a nap layer made solely of a polycarbonate resin and containing a plurality of pores having an average opening size of 50 μm. On similar analysis, the substrate had an average of 25 defects with a major diameter of the order of 40 nm or greater and a surface roughness (Rms) of 0.22 nm.

Example 3

A synthetic quartz glass substrate stock as sliced (6 inch squares and 6.35 mm thick) was lapped on a double-side lapping machine of planetary motion, and roughly polished on a double-side polishing machine of planetary motion, obtaining a starting substrate. The starting substrate was polished under the same conditions as in Example 1 except that the polishing pad of Example 1 was provided with U-shaped grooves at a pitch of 30 mm, and the polishing slurry was a water dispersion of colloidal silica having a $SiO_2$ concentration of 40 wt % (Fuso Chemical Co., Ltd., particle size 23 nm). After polishing, cleaning and drying, the substrate was inspected for defects using a laser confocal optics high-sensitivity defect inspection system (Lasertec Corp.), finding an average of 0.4 defect with a major diameter of the order of 40 nm or greater. The substrate had a surface roughness (Rms) of 0.08 nm.

Example 4

A wafer as sliced (diameter 6 inches, 0.775 mm thick) was lapped on a double-side lapping machine of planetary motion, and roughly polished on a double-side polishing machine of planetary motion, obtaining a starting substrate. The starting substrate was polished using the polishing pad of Example 3 and a water dispersion of colloidal silica having a $SiO_2$ concentration of 20 wt % (Fuso Chemical Co., Ltd., particle size 93.5 nm) as the polishing slurry and under a polishing pressure of 80 gf/cm$^2$. After polishing, cleaning and drying, the substrate had a surface roughness (Rms) of 0.15 nm. None of flaws caused by polishing, known as scratches or pits, were detected.

Example 5

A synthetic quartz glass substrate stock as sliced (G6 size, 800×960 mm) was lapped on a double-side lapping machine of planetary motion, and roughly polished on a double-side polishing machine of planetary motion, obtaining a starting substrate. The starting substrate was polished using a polishing pad and a polishing slurry. The polishing pad had a nap layer made of a base resin composition consisting of three resins, 65 wt % of an ether resin, 30 wt % of an ester resin and 5 wt % of a polycarbonate resin, containing a plurality of pores having an average opening size of 50 μm, and provided with U-shaped grooves at a pitch of 30 mm. The polishing slurry was a water dispersion of colloidal silica having a $SiO_2$ concentration of 40 wt % (Nissan Chemical Industries Co., Ltd., particle size 78.0 nm). The polishing pressure was 90 gf/cm$^2$ and the polishing allowance was 10 μm. After polishing, cleaning and drying, the substrate was inspected for defects using a catoptric high-sensitivity defect inspection system (Lasertec Corp.), finding an average of 0 defect with a major diameter of the order of 0.22 μm or greater. The substrate had a surface roughness (Rms) of 0.17 nm.

Example 6

The starting substrate and the polishing pad were the same as in Example 5. A number of substrates were polished under the same conditions with the polishing pad over 300 hours. Substrates were sampled out at a pad operating time of 5 hours, 100 hours, 200 hours and 300 hours. The substrate samples were etched to a depth of 10 nm, before they were inspected for defects using a catoptric high-sensitivity defect inspection system (Lasertec Corp.). The number of defects with a major diameter of the order of 0.22 μm or greater was 2 on average at the pad operating time of 5 hours and remained the same at the time of 300 hours. The surface roughness (Rms) remained equal to 0.17 nm among the substrate samples.

Example 7

A synthetic quartz glass substrate stock as sliced (G8 size, 1220×1400 mm) for photomask was lapped on a single-side lapping machine of oscillation motion, and roughly polished on a single-side polishing machine of oscillation motion, obtaining a starting substrate. The starting substrate was polished using the same polishing pad as in Example 5 and a water dispersion of colloidal silica having a $SiO_2$ concentration of 40 wt % (Nissan Chemical Industries Co., Ltd., particle size 78.0 nm) as the polishing slurry. The polishing pressure was 80 gf/cm$^2$ and the polishing allowance was 10 μm. After polishing, cleaning and drying, the substrate was inspected for defects using a catoptric high-sensitivity defect inspection system (Lasertec Corp.), finding an average of 2 defects with a major diameter of the order of 0.22 μm or greater. The substrate had a surface roughness (Rms) of 0.15 nm.

Example 8

The starting substrate and the polishing pad were the same as in Example 7. A number of substrates were polished under the same conditions with the polishing pad over 200 hours.

Substrates were sampled out at a pad operating time of 5 hours, 40 hours, 100 hours and 200 hours. The substrate samples were etched to a depth of 10 nm, before they were inspected for defects using a catoptric high-sensitivity defect inspection system (Lasertec Corp.). The number of defects with a major diameter of the order of 0.22 μm or greater was 15 on average at the pad operating time of 5 hours and remained the same at the time of 200 hours. The surface roughness (Rms) remained equal to 0.15 nm among the substrate samples.

Comparative Example 3

The starting substrate was the same as in Example 5. Polishing was performed under the same conditions as in Example 5 except that the polishing pad had a nap layer made solely of an ester resin and containing a plurality of pores having an average opening size of 50 μm. On similar analysis, the substrate had an average of 5 defects with a major diameter of the order of 0.22 μm or greater and a surface roughness (Rms) of 0.20 nm.

Comparative Example 4

The starting substrate was the same as in Example 6. Polishing was performed under the same conditions as in Example 6 except that the polishing pad had a nap layer made solely of an ester resin and containing a plurality of pores having an average opening size of 50 μm. The substrate samples were inspected for defects using a catoptric high-sensitivity defect inspection system. The average number of defects with a major diameter of the order of 0.22 μm or greater was 10 at the pad operating time of 5 hours, and 20 at the time of 200 hours, and exceeded 30 at the time of 300 hours and later. The substrates had a surface roughness (Rms) of 0.22 nm.

Comparative Example 5

The starting substrate was the same as in Example 7. Polishing was performed under the same conditions as in Example 7 except that the polishing pad had a nap layer made solely of an ester resin and containing a plurality of pores having an average opening size of 50 μm. On similar analysis, the substrate had an average of 15 defects with a major diameter of the order of 0.22 μm or greater and a surface roughness (Rms) of 0.18 nm.

Comparative Example 6

The starting substrate was the same as in Example 8. Polishing was performed under the same conditions as in Example 8 except that the polishing pad had a nap layer made solely of an ester resin and containing a plurality of pores having an average opening size of 50 μm. The substrate samples were inspected for defects using a catoptric high-sensitivity defect inspection system. The average number of defects with a major diameter of the order of 0.22 μm or greater was 30 at the pad operating time of 5 hours, and 500 at the time of 40 hours, and exceeded 5,000 at the time of 100 hours and later. The substrates had a surface roughness (Rms) of 0.20 nm.

Japanese Patent Application No. 2011-249345 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method of preparing a substrate, comprising the step of polishing a surface of the substrate using a polishing pad along with a polishing slurry, said polishing pad having a porous nap layer made of a base resin comprising at least three resins including 55 to 85% by weight of an ether resin, 10 to 35% by weight of an ester resin and 5 to 10% by weight of polycarbonate resin, the nap layer coming in contact with the substrate surface, wherein the ether resin in polyhexamethylene ether or polyphenylene ether, the ester resin is polyethylene succinate, polybutylene succinate or polyethylene adipate, and the polycarbonate resin is polyethylene carbonate or polyhexamethylene carbonate.

2. The method of claim 1 wherein the polishing slurry is a polishing slurry containing colloidal particles.

3. The method of claim 2 wherein the colloidal particles are colloidal particles of silica, ceria or zirconia.

4. The method of claim 1 wherein the polishing step is a final polishing step.

5. The method of claim 1 wherein the substrate is a synthetic quartz glass or silicon substrate.

* * * * *